US005653010A

United States Patent [19]

Grossenbacher et al.

[11] Patent Number: 5,653,010

[45] Date of Patent: Aug. 5, 1997

[54] METHOD AND DEVICE FOR TEXTURING THERMOPLASTIC YARNS

[75] Inventors: Peter Grossenbacher, Winterthur; Jorg Maier, Frauenfeld, both of Switzerland

[73] Assignee: Maschinenfabrik Rieter AG, Winterthur, Switzerland

[21] Appl. No.: 256,085

[22] PCT Filed: Nov. 17, 1993

[86] PCT No.: PCT/CH93/00262

§ 371 Date: Jun. 29, 1994

§ 102(e) Date: Jun. 29, 1994

[87] PCT Pub. No.: WO94/11551

PCT Pub. Date: May 26, 1994

[30] Foreign Application Priority Data

Nov. 19, 1992 [CH] Switzerland ..... 03547/92

[51] Int. Cl.[6] ..... D02G 1/12

[52] U.S. Cl. ..... 28/256; 28/257; 28/247

[58] Field of Search ..... 28/221, 247, 250, 28/254, 255, 256, 257, 258, 262, 263, 264

[56] References Cited

U.S. PATENT DOCUMENTS 3,534,922 10/1970 Keith et al. .
4,877,570 10/1989 Nabulon .
4,936,000 6/1990 Nabulon et al. ..... 28/255
4,974,302 12/1990 Nabulon .
5,339,502 8/1994 Grossenbacher et al. .
5,375,311 12/1994 Nabulon ..... 28/256

FOREIGN PATENT DOCUMENTS 0039763 9/1985 European Pat. Off. .
0310890 4/1989 European Pat. Off. .

OTHER PUBLICATIONS

International Search Report and Annex.

*Primary Examiner*—C. D. Crowder
*Assistant Examiner*—Larry D. Worrell, Jr.
*Attorney, Agent, or Firm*—Greenblum & Bernstein, P.L.C.

[57] ABSTRACT

Method and apparatus for texturing thermoplastic threads. In starting the operation of the texturing device, one or several non-textured yarns can be drawn in more easily and more reliably via a drawing-in yarn guide which guides the at least one yarn for the purpose of drawing same into the feed channels of the texturizing nozzle and into the plug channels of the plug feed roller essentially parallel to these channels and at a predetermined distance from each other.

23 Claims, 5 Drawing Sheets

METHOD AND DEVICE FOR TEXTURING THERMOPLASTIC YARNS

CROSS REFERENCE TO RELATED APPLICATIONS

This application claims the priority under 35 U.S.C. § 119 of Swiss Application No. 03 547/92-5, filed Nov. 19, 1992.

BACKGROUND OF THE INVENTION

1. Field of the Invention

The invention relates to the processing of yarns made from a thermoplastic material and concerns a method and a device, for continuous texturing of yarns made from a thermoplastic material.

2. Discussion of the Background of the Invention and Material Information

Devices for continuous texturing of thermoplastic yarns are known, for example, from European Patent Specification No. 310890 also assigned to the assignee of this invention. The devices described consist, essentially, of a texturing nozzle with a feed channel and a nozzle outlet and a driven plug feed roller with a pair of lateral guides, for example, a paired row of needles (needle roller) extending around the circumference of the plug feed roller. The texturing nozzle is arranged in relation to the plug feed roller so that the feed channel, or at least the end of the feed channel bearing the nozzle outlet, runs essentially tangentially to the plug feed roller and extends, together with the nozzle outlet, between the rows of needles. When the texturing device is operated, the yarn runs through the feed channel towards the nozzle outlet, being driven and simultaneously heated by a feed medium which flows through the feed channel under pressure. Upon emission or exit from the nozzle outlet the feed medium expands and the yarn impinges on a plug which has formed, between the rows of needles, from the yarn which has already emerged from the nozzle outlet. The plug is conveyed away from the nozzle outlet by the rotational motion of the plug feed roller (needle roller) at a plug feed velocity which is less than the feed velocity of the yarn within the feed channel. The plug passes from the nozzle outlet over a sector of the plug feed roller (plug sector), guided by the rows of needles and slightly separated from the circumferential surface of the plug feed roller. At the end of this sector, the plug is passed from the plug feed roller to a cooling element, for example a cooling drum, by means of a plug separator, for example a stationary separating wedge.

For simultaneous parallel texturing of multiple yarns, a multiplicity of devices such as those described are arranged adjacent to each other, the texturing nozzle generally having a number of feed channels running parallel to each other and the plug feed roller having a number of pairs of lateral guides, for example, paired rows of needles, running parallel to each other.

It is thus evident that the starting of such arrangements demands the exercise of increased levels of care by the operating personnel, particularly with respect to the drawing-in of the yarns into devices in which a multiplicity of yarns are textured in parallel.

The task or object of the invention, therefore, is to improve a method and device for the continuous texturing of thermoplastic yarns so that the process of drawing-in, particularly the drawing-in of multiple parallel yarns, is simplified and rendered more reliable. The operating process is not to be affected in any way.

SUMMARY OF THE INVENTION

This task or object is solved by the method and device of this invention as per the appended claims. Specifically, one embodiment of this invention includes a method for the continuous texturizing of at least one yarn, made from a thermoplastic material, by means of a texturing nozzle with at least one feed channel, at least one nozzle outlet and a first yarn guide located at an inlet, a plug feed roller with at least one pair of lateral plug guides, at least one plug separator and a plug cooling mechanism, wherein the method comprises: guiding, at the start of the method, each untextured yarn to be drawn in, by a first yarn guide and by a drawing-in yarn guide; and laying each yarn centrally between the lateral plug guides on the plug feed roller.

A variation of the method of the previous embodiment further includes guiding the untextured yarn via a first yarn guide and the drawing-in yarn guide for all possible yarn paths between a path on a tangent line from the first yarn guide to a cylindrical surface formed by the lateral plug guides and a path in which the yarn passes over a sector of the plug feed roller to a second yarn guide.

A further variation of the method of the noted embodiment further includes guiding the untextured yarn during the drawing-in by the first yarn guide, the drawing-in yarn guide and, additionally, by means of guiding grooves on the plug feed roller.

Another variation of the method of the noted embodiment further includes keeping the drawing-in yarn guide stationary; and guiding the untextured yarn within a guiding slot.

A yet further variation of the method of the noted embodiment further includes keeping the drawing-in yarn guide stationary; and guiding the untextured yarn within a guiding slot.

A differing variation of the noted embodiment further includes moving the drawing-in yarn guide during the drawing-in process; guiding the untextured yarn by a guide rod; and equipping one of a feed part and a guide rod with grooves.

One embodiment of this invention pertains to a device for the continuous texturing of at least one yarn, made from a thermoplastic material, the device including: a texturing nozzle with at least one channel; a first yarn guide located in the area of an inlet to the feed channel; at least one nozzle outlet; a plug feed roller with at least one pair of lateral guides; at least one plug separator and a plug cooling mechanism, the device also including a drawing-in yarn guide for drawing-in the at least one yarn at the start of the method. Preferably, the device is used for the continuous texturing of multiple parallel yarns.

In a variation of the previous embodiment, the drawing-in yarn guide is stationary and is disposed so as to extend around a part of the circumference of the plug feed roller while being separated therefrom by a space, and having a guiding slot for the purpose of guiding the at least one yarn.

In another variation of the noted device, drawing-in yarn guide includes a feed section, the feed section being located on the side, facing away from the plug feed roller, of a tangential plane from the first yarn guide to the cylindrical surface formed by the outer circumferences of the lateral guides, a guide section adjoining the feed section and extending towards the plug separator with at least one guiding slot and a plug passage section located in the area of the plug separator with at least one plug passage aperture, each guiding slot opening into a plug passage aperture.

In a further variation of the noted device, each guiding slot continues on the opposite side of the plug passage aperture.

In a differing variation of the noted device, the drawing-in yarn guide is designed and disposed so that its distance from the circumference of the plug feed roller varies.

In yet another variation of the noted device, the drawing-in yarn guide includes a guide rod which is positioned parallel to the axis of the plug feed roller and separated from its circumference by a space and linked to a means for driving so that, during the drawing-in process, the yarn guide can be moved around a part of the circumference of the plug feed roller. Preferably, the guide rod includes a feed part and at least one guiding groove.

In yet a differing variation of the noted device, the plug feed roller includes a guiding groove located between and parallel to each of the lateral guides.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein:

FIG. 1*a* illustrates the operation;

FIG. 1*b* illustrates the first drawing-in phase;

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Described below are methods and devices for texturing a thermoplastic yarn and, in particular, for drawing-in the still untextured yarn into the device at the start of operation. Methods and devices for multiple yarns may easily be derived from these descriptions, since the yarn/plug paths run in parallel, spaced at regular predetermined intervals.

Figure 1B:
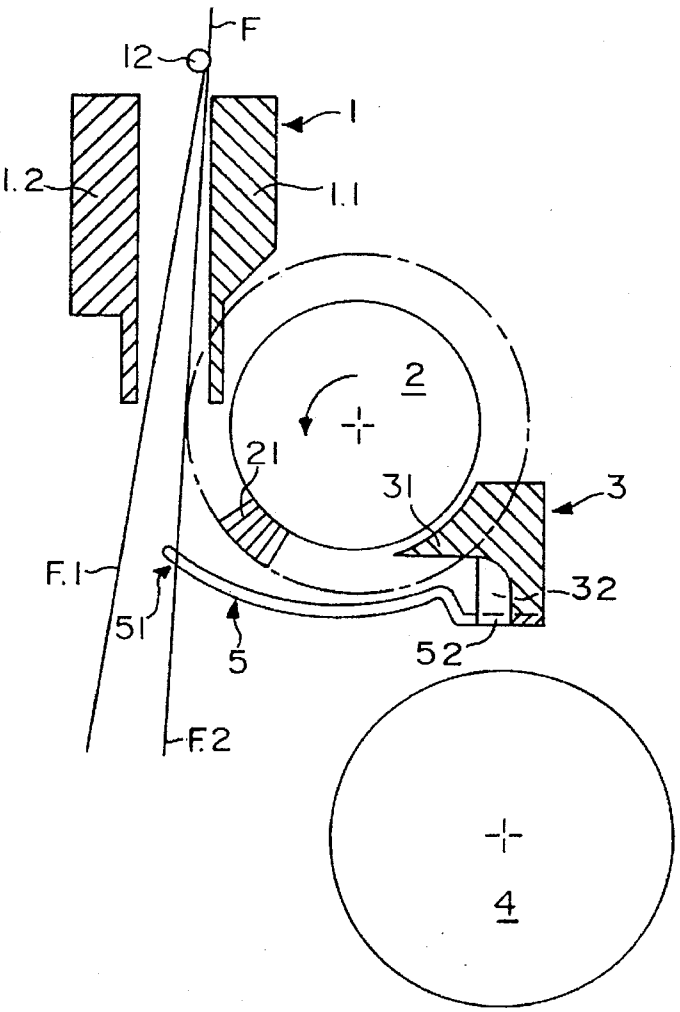
FIGS. 1*a* 1*b* illustrate an exemplary design of the device according to the invention for continuous texturing of a yarn, as a highly schematic section along the yarn/plug path, for the purpose of explaining the method constituting the subject-matter of the invention, using a stationary drawing-in yarn guide with a guiding slot.
Figure 1A:
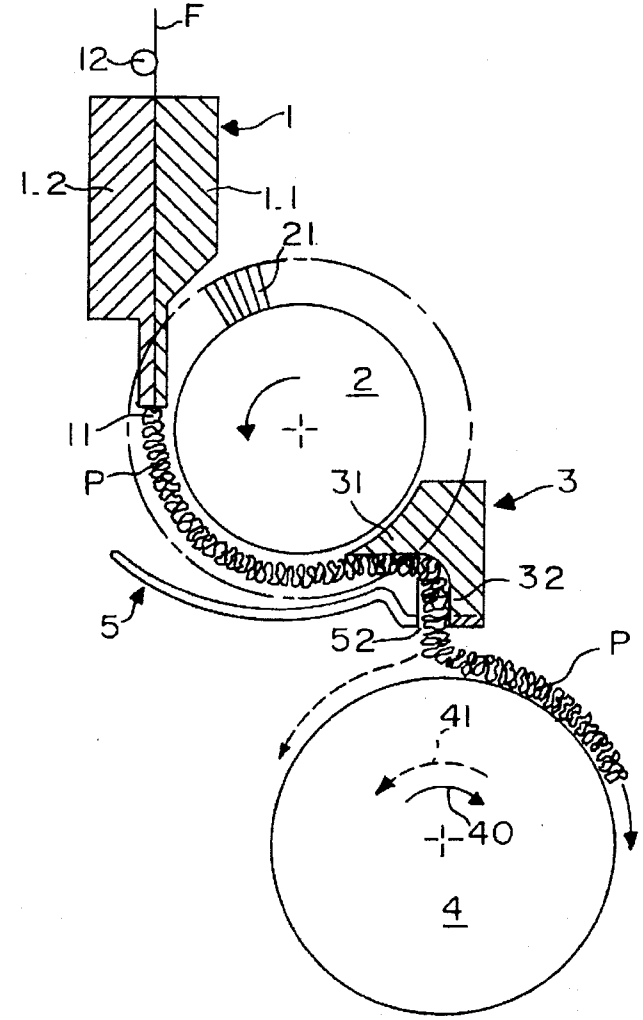
Figure 1C:
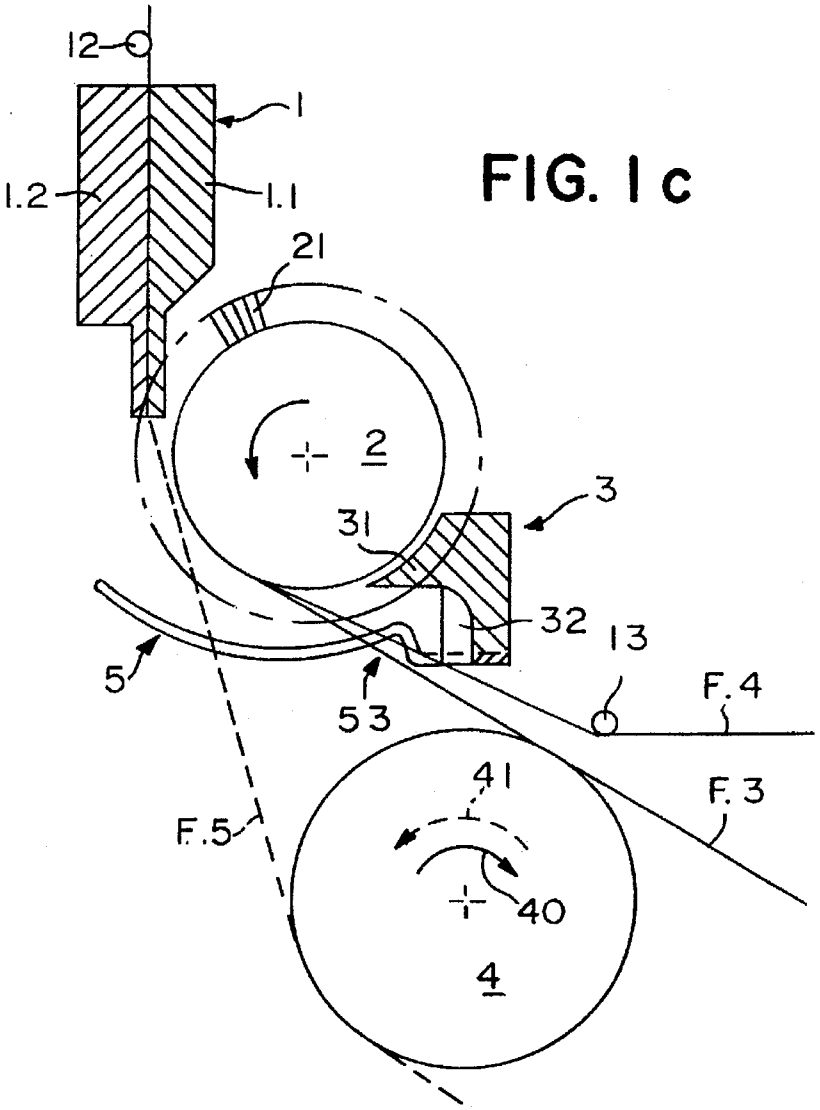
FIG. 1*c* illustrates the second drawing-in phase.

FIGS. 1*a* to 1*c* show an exemplary design of a device for continuous texturing in different phases: FIG. 1*a* in the operating phase, FIG. 1*b* in a first drawing-in phase and FIG. 1*c* in a second drawing-in phase. The device is comprised essentially, of a texturing nozzle 1, a plug feed or guide or transport roller, for example a needle roller 2 (described, for example, in already previously cited European Patent Specification No. 310890 ), a plug separator 3, for example a separating wedge 31 and a connecting separating channel 32, and a plug cooler, for example a cooling drum 4 which can rotate in the two directions indicated (by the unbroken and broken lines). The device also comprises a drawing-in yarn guide 5. The figures represent sections along the yarn/plug path. Accordingly, the drawing-in yarn guide is also shown in section (section line II—II in FIG. 4).

As described in the European Patent Specification No. 39763 also assigned to the assignee of this invention, the texturing nozzle normally consists of two parts, 1.1 and 1.2, whereby it is advantageous for the part 1.1 which is closer to the needle roller 2 to be stationary, the other part being movable, so that the texturing nozzle can be opened for drawing-in.

FIG. 1*a* shows the yarn/plug path in operation. The yarn F runs through the closed texturing nozzle 1. The yarn leaves the texturing nozzle 1 at the nozzle outlet 11. Directly outside this outlet, which extends between the lateral guides 21 (paired rows of needles, shown as a dot-dash line along the outer circumference) of the needle roller 2, there is formed a plug P which is passed through the paired rows of needles so that it does not contact the base of the needle roller. The plug is advanced by the rotation of the needle roller 2, whilst being laterally retained by the rows of needles 21. The separating wedge 31 and the separating channel 32 (where provided) move the plug P away from the needle roller 2 to the cooling drum 4, which can rotate either in the direction opposite to the direction of rotation of the plug feed roller (variant indicated by solid arrow 40) or in the same direction of rotation as the plug feed roller (variant indicated by segmented arrow 41).

FIG. 1*a* also shows the drawing-in guide 5, which has no function during operation. The function and design of this drawing-in guide are described in greater detail below, with reference to FIGS. 1*b* and 1*c*. The exemplary embodiment of the yarn guide illustrated is fixed to the plug guide channel 32 and possesses an appropriate plug passage aperture 52 or recess to allow passage of the plug.

A device of this type can be used for texturing a single yarn F, as illustrated in the Figure or, alternatively, as is usual, further yarn/plug paths are arranged parallel to the yarn/plug path shown (in FIG. 1*a*, above and/or below the plane of the paper).

To start operation, as illustrated in FIG. 1*a*, it is necessary for an untextured yarn to be drawn into the device.

FIG. 1*b* shows a first drawing-in phase. The yarn F is positioned in the opened texturing nozzle by means of a string up gun. The yarn bears against a first yarn guide 12, positioned at the inlet of the texturing nozzle, the yarn guide being in the form of, for example, a guide rod with a groove for the yarn, the groove being aligned with the feed channel in the texturing nozzle. The yarn follows a path, for example, F.1. The yarn is then moved towards the plug feed roller 2 by means of the string up gun. When the yarn has assumed the path F.2, i.e., when it comes into the vicinity of the rows of needles, it must be ensured by means of appropriate guides that the path of the yarn is such that it does not conflict with the rows of needles. In relation to the figure, this means that during operation the path of the yarn must be exactly that of the plane of the paper, i.e., it must run in the same plane as the yarn/plug path. This guide function is performed by both the first yarn guide 12 and by, for example, the stationary drawing-in yarn guide 5. The drawing-in yarn guide 5 possesses, for this purpose, a guiding slot which is disposed parallel to the paired rows of needles and aligned centrally relative to the latter.

The drawing-in yarn guide is disposed so that when the yarn assumes a path F.2 or is moved closer to the plug feed roller it runs through this slot.

Whereas the yarn path F.1 at right angles to the movement of the yarn (out from the plane of the paper) is dependent, from the first yarn guide 12 onwards, only on the position of the movable string up gun, and is therefore not precisely determined, the yarn path F.2 between the yarn guide 12 and the drawing-in guide 5 is precisely determined, running in a precise alignment to the feed channel in the texturing nozzle and the plug channel formed by the rows of needles.

The position 51 on the drawing-in guide 5, which is the ultimate position at which exact guidance of the yarn must commence for movement of the yarn towards the plug feed roller, lies on the tangent line from the first yarn guide 12 to the circle formed by the outer ends of the rows of needles 21. It is advantageous for the guiding slot of the drawing-in yarn guide 5 to project slightly beyond this tangent line, on the side facing away from the plug feed roller.

FIG. 1*c* then shows a second drawing-in phase which follows the first and in which the yarn is moved further towards the cooling drum 4. Shortly before the yarn is effectively laid on the cooling drum (yarn paths F.3 for the direction of rotation of the cooling drum indicated by solid arrow 40, and F.5 for the direction of rotation of the cooling drum indicated by segmented arrow 41, and before the yarn is retarded, it is necessary for the texturing nozzle to be closed, the feed medium to be switched on and the formation of a plug to be initiated by means of a yarn accumulation aid, for example by an air current directed towards the nozzle outlet.

For the operating variant of the cooling drum 4 illustrated in FIGS. 1*a* and 1*c* with solid arrow 40, the yarn is passed between the plug feed roller 2 and the cooling drum 4, and then laid on the cooling drum, corresponding to the yarn path F.3. In this case, it is not possible to avoid the absolute necessity of further laying the yarn around the plug feed roller 2 (yarn path F.4). In order that the yarn cannot be damaged in this movement by the plug separator 3 it is advantageous to limit this movement with an appropriate second yarn guide 13. As in the case of the yarn guide 12, it is advantageous for the yarn guide 13 to have the form of a guide rod, with a groove for the yarn. The yarn guide 13 can also be positioned directly under the plug channel 32.

For the operating variant of the cooling drum 4 illustrated with a segmented arrow 41, it is only necessary for the yarn to be moved to a yarn path F.5 and to be guided during this movement by the guiding slot in the drawing-in yarn guide.

As soon as a plug of sufficient length has formed, it will assume the path indicated in FIG. 1*a* and the drawing-in yarn guide 5 has then performed its function.

Generally, and as illustrated in FIGS. 1*b* and 1*c*, the drawing-in yarn guide 5 must be designed and positioned so that, together with the first yarn guide 12, it guides the untextured yarn parallel to and centrally from the feed channel and the plug channel for all yarn paths possible during drawing-in in which the yarn passes through the region of the rows of needles. In relation to the device illustrated in FIGS. 1*a* to 1*c*, this means: in the case of a cooling drum rotation as indicated by the segmented arrow 41 (clockwise), for all yarn paths between the yarn paths F.2 and F.4 and, in the case of a cooling drum rotation as indicated by the segmented arrow 41 (counter-clockwise), for all yarn paths between the yarn paths F.2 and F.5.

The yarn guide 5 illustrated in FIG. 1*a*, 1*b*, 1*c* is stationary, extending around the circumference of the needle roller 2 and separated from it by a space. It possesses a guiding slot or, for multiple yarns, a corresponding number of parallel guiding slots separated at intervals corresponding to the predetermined yarn spacings, extending at least between the points 51 (intersection with the yarn path F.2) and the plug passage aperture 52 and aligned with the feed and plug channels. The stationary yarn guide 5 is described in detail below, with reference to FIGS. 3 and 4.

FIGS. 1*a* to 1*c* show how, during the drawing-in process with the cooling drum rotating clockwise, the untextured yarn moves from a yarn path F.1 through F.2 and, where applicable, F.4 to a yarn path F.3 and in each case is guided into the guiding slot of the drawing-in yarn guide 5. From a concept of this type it can easily be deduced that, instead of a stationary drawing-in yarn guide 5 with a guiding slot as shown in FIGS. 1*a* to 1*c*, it is also possible to use a yarn guide disposed parallel to the axis of the needle roller and moving, during the drawing-in process, essentially from the position 51 (FIG. 1*b*) to the position of the second yarn guide 13 (FIG. 1*c*).

Obviously, this also applies, with appropriate application, to a cooling drum 4 rotating in a counter-clockwise direction, in which case the yarn which is to be drawn in moves from a yarn path F.1 through F.2 to F.5.

Figure 2:
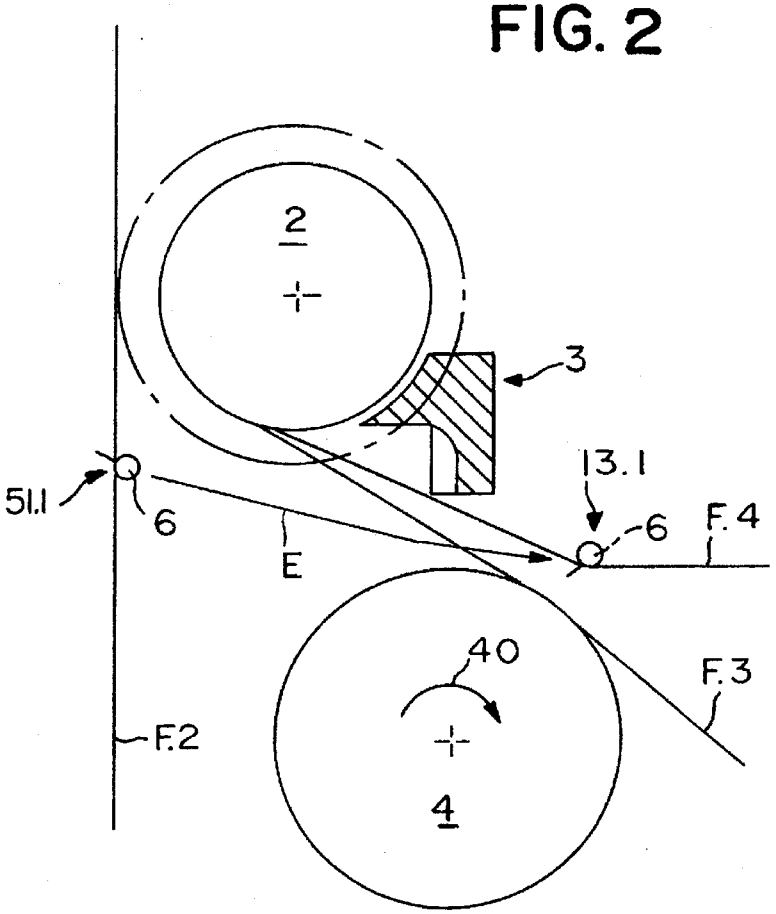
FIG. 2 illustrates the same as FIGS. 1*a* 1*b* and 1*c*, using a movable drawing-in yarn guide.
Figure 5:
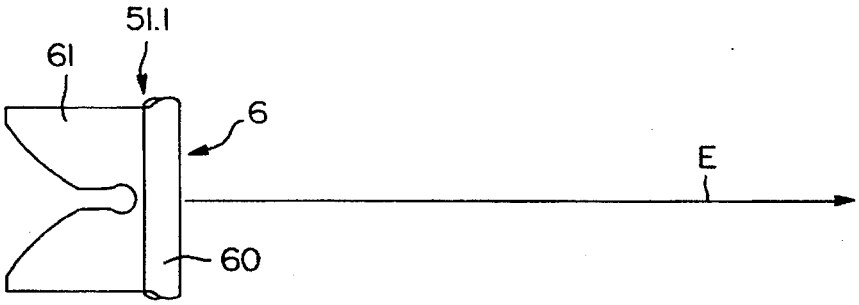
FIG. 5 illustrates a horizontal projection of an exemplary movable drawing-in yarn guide for the device as in FIG. 2.

FIG. 2 shows in highly schematic form a moving yarn guide of this type, in which the device, which is not shown in full, is essentially the same as that illustrated in FIGS. 1*a* to 1*c*. The moving yarn guide is a rod-type drawing-in yarn guide 6 which is disposed parallel to the axis of the plug feed roller 2 and which moves during the drawing-in process at least from a position 51.1, corresponding to the position 51 of FIG. 1*b*, to a position 13.1 (arrow E), the position 13.1 corresponding essentially to the position of the second yarn guide 13 of FIG. 1*c*. In this movement the drawing-in yarn guide 6 retains its position parallel to the axis of the plug feed roller. The moving drawing-in yarn guide 6, the design of which is described below with reference to FIG. 5, is linked to an appropriate drive from which it derives its motion and, advantageously, to an appropriate control system (neither of which are illustrated).

Figure 3:
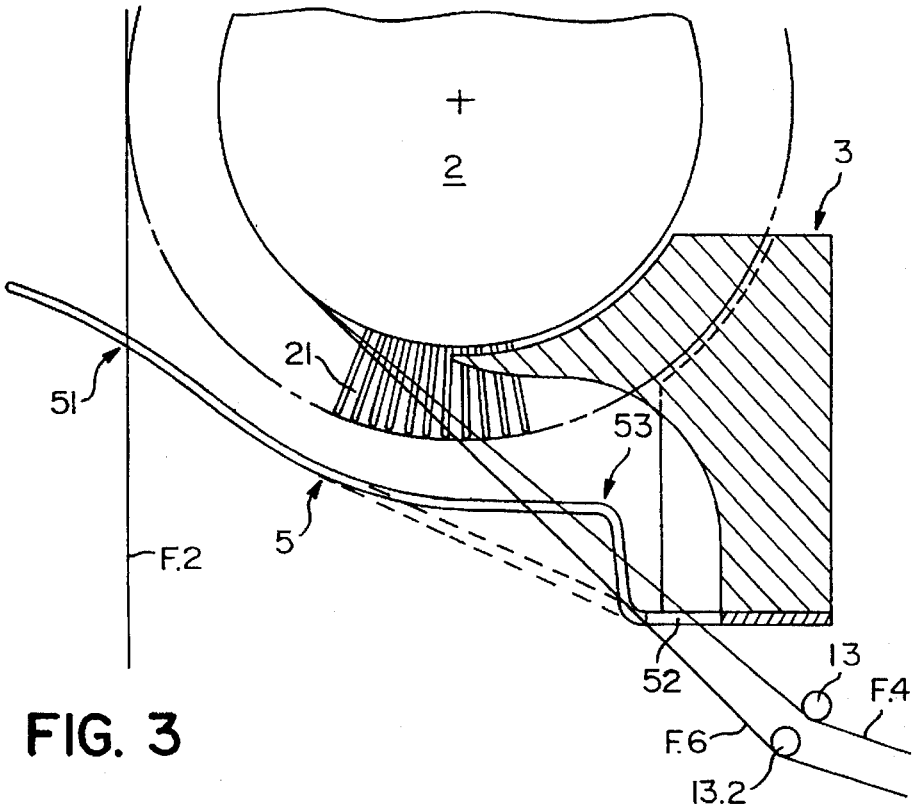
FIG. 3 illustrates in greater detail a part of the design as in FIGS. 1*a* to 1*c*, in the same projection.
Figure 4:
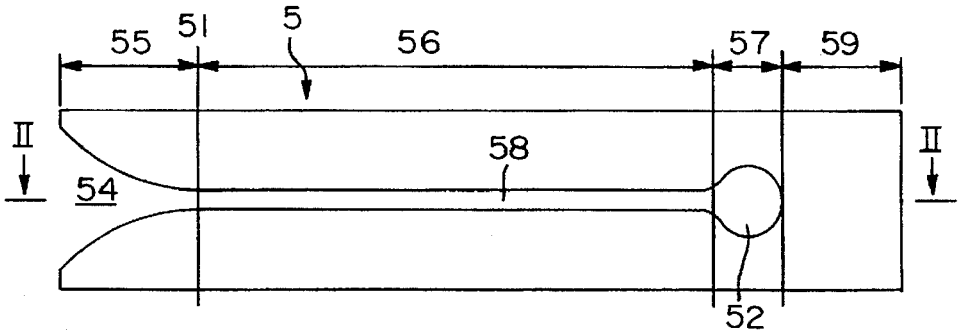
FIG. 4 illustrates a horizontal projection of an exemplary stationary drawing-in yarn guide for the device as in FIGS. 1*a* to 1*c*.

FIGS. 3 and 4 show in more detail a stationary drawing-in yarn guide 5 such as has already been illustrated and described for the exemplary design as per FIGS. 1*a* to 1*c*, the same reference numbers therefore being used. Parts of the device for continuous texturing of thermoplastic yarns having the drawing-in yarn guide 5 are shown in section in FIG. 3, along the yarn/plug path (section line II—II of FIG. 4). FIG. 4 shows a horizontal projection of the drawing-in yarn guide 5 as viewed from the plug feed roller.

As already mentioned several times, the stationary drawing-in yarn guide 5 possesses a guiding slot 58 which extends at least from the position 51 (intersection with the yarn path F.2) to the plug passage aperture 52. It also possesses a feed section 55 which is located on the side of the yarn path F.2 facing away from the plug feed roller 2 and in which the guiding slot 58 opens out to form a feed aperture 54. The function of the feed section is to guide the yarn into the guiding slot 58. The drawing-in yarn guide also possesses a guiding section 56 and a plug passage section 57. The guiding slot 58, which opens out within the plug passage section 57 to form an aperture 52, extends along the length of the guiding section 56. A retaining section 59 can adjoin the plug passage section 57.

Depending on the position of the yarn guide 13, yarn paths are possible whereby the yarn runs through the plug passage aperture 52 (for example, yarn path F.4). The yarn is not guided precisely within this aperture. In order that the position of the yarn is sufficiently defined in this path, the yarn guide has a bend at the position 53, as shown in FIG. 3, which converges with the needle roller so that the yarn, following a path as per path F.4, is guided within the guiding slot 58. If the yarn guide 5 does not have a bend of this type, running instead essentially in a straight line over the section 53 (shown by a dot-dash line), it is advantageous to avoid a yarn path as per F.4, for example by appropriate positioning of the second yarn guide (13.2, yarn path F.6). It is also advantageous if the second yarn guide possesses a groove (not shown) and thereby helps to guide the yarn at right angles to the yarn/plug path.

Drawing-in yarn guides for devices for texturing multiple yarns running in parallel possess a corresponding number of parallel guiding slots.

FIG. 5 shows, in the same horizontal projection as FIG. 4, an exemplary design for a movable drawing-in yarn guide 6, for example for an application as per FIG. 2. The movable drawing-in yarn guide could also replace the stationary drawing-in yarn guide in FIG. 3. FIG. 5 is aligned with FIG. 3 so that the movable yarn guide 6 assumes the position that it essentially assumes at the start of the drawing-in process. During the drawing-in process it is moved along the direction of arrow E. The movable drawing-in yarn guide 6 possesses for example a guide rod 60 and a feed part 61 (similar to the feed section 55 of the drawing-in yarn guide 5, FIG. 4). The yarn path F.2 intersects the yarn guide in its initial position at the position 51.1. A guide rod, for example, having a guiding groove (not shown) for the yarn around its circumference could be used instead of a two-part drawing-in yarn guide 6, as illustrated in FIG. 5.

As in the case of the stationary drawing-in yarn guide 5, a movable yarn guide for a device for texturing multiple yarns is correspondingly wider and equipped with multiple yarn guiding systems.

Figure 6:
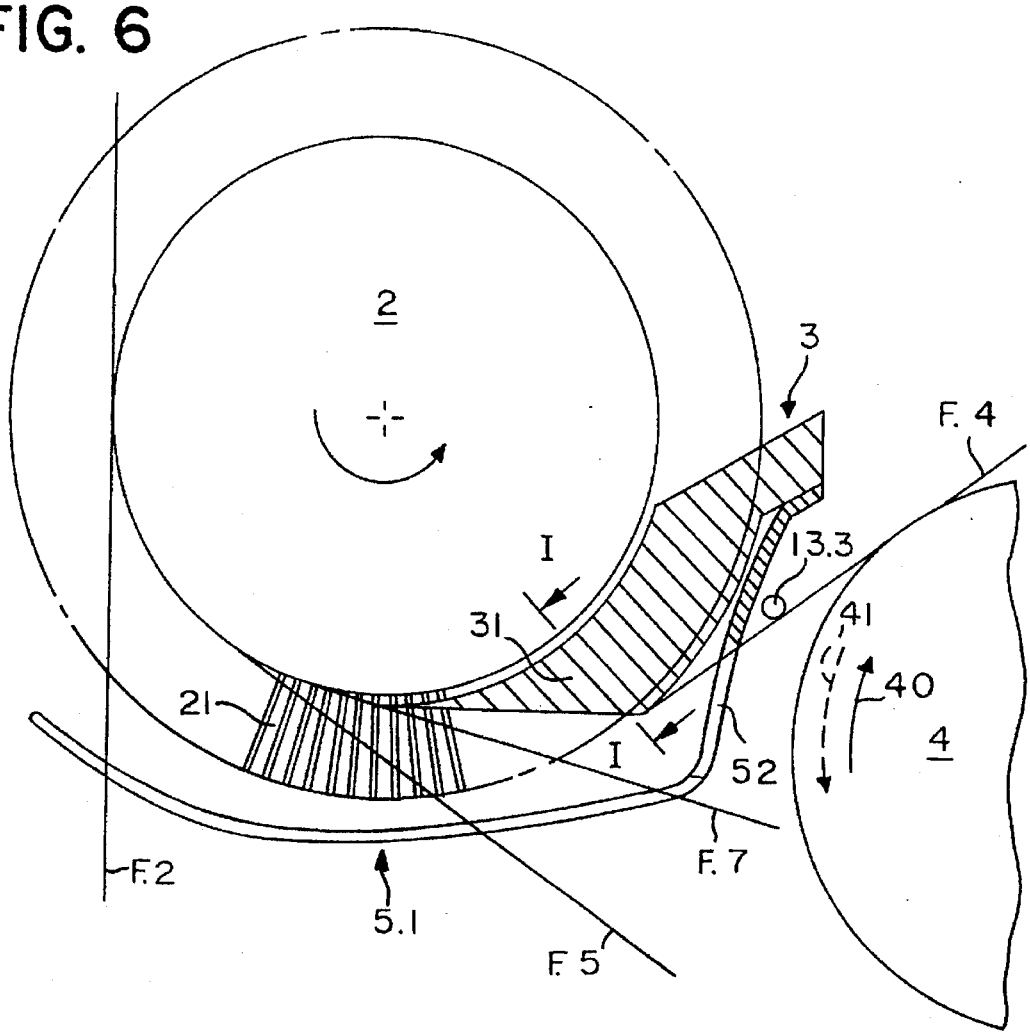
FIG. 6 illustrates a further exemplary design of the device according to the invention, again as a section along the yarn/plug path.

FIG. 6 again shows parts of a further exemplary design of the device for continuous texturing of a thermoplastic yarn. This design differs essentially from the designs described above in the relative positioning of the needle roller 2 and the cooling drum 4 whereby, in particular, the plug is drawn essentially horizontally from the plug feed roller and is sucked directly on to the cooling drum, without a plug feed channel, by the air which is sucked radially into the cooling drum for the purpose of cooling and retaining the plug. FIG. 6 illustrates that the method according to the invention and the corresponding device permit a variety of such arrangements wherein it is necessary for the drawing-in yarn guide to be adapted or supplemented.

FIG. 6 shows that the adapted stationary drawing-in yarn guide 5.1 guides the yarn between a yarn path F.2 and a yarn path F.7. If the yarn is laid further around the plug feed roller, this being necessary only in the case of operation of the cooling drum as indicated by solid arrow 40, the yarn passes through the plug passage aperture 52 without being guided within it. On the other side of the plug passage aperture (yarn path F.4), the function of guiding the yarn can be assumed by a second yarn guide 13.3 (for example, a rod with guiding grooves), so that the yarn is again guided. In order to avoid inadequate guidance of the yarn in the area of the plug passage aperture the plug feed roller 2 can be equipped with appropriate guides, as illustrated in FIG. 7.

Figure 7:
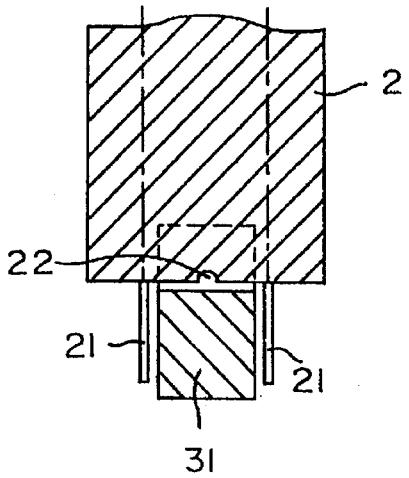
FIG. 7 illustrates a section (corresponding to the section line I—I in FIG. 6) at right angles to the yarn path, using exemplary designs of a needle roller and a separator with yarn guiding grooves.

FIG. 7 shows a schematic radial section (section line I—I, FIG. 6) through a needle roller 2 (shown in part only) with a plug channel delimited by a paired row of needles 21. A guiding groove 22, which guides the non-textured yarn during drawing-in, runs centrally within the plug channel at the base of the needle roller. The figure also shows a separating wedge 31. The needle roller as in FIG. 7 can be used, for example, for the application illustrated in FIG. 6, with a cooling rotational direction as indicated by segmented arrow 41. For this application, the yarn is guided during drawing-in from a yarn path F.2 to a yarn path F.4.

Figure 8:
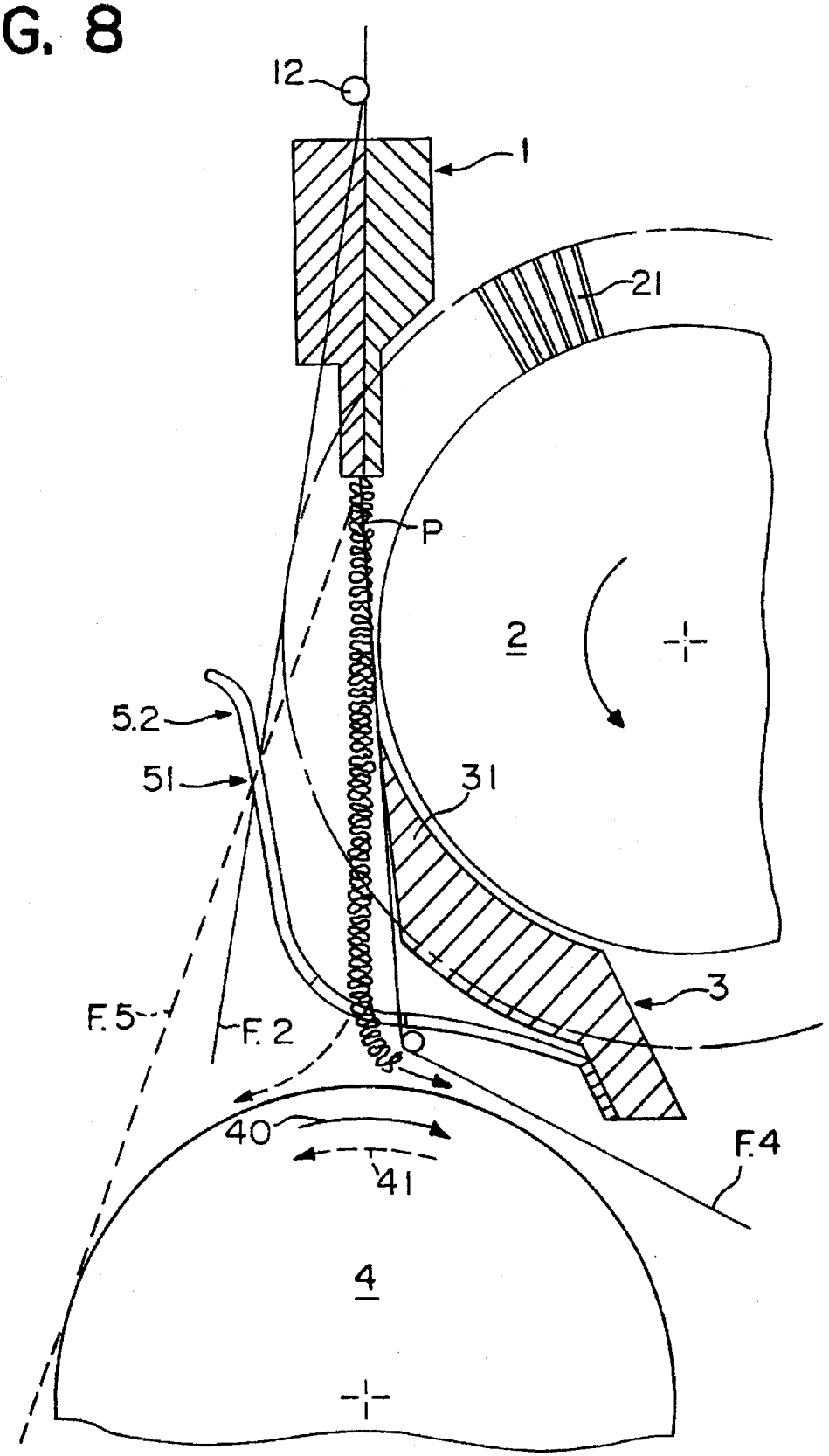
FIG. 8 illustrates a further design of the device according to the invention, in the same projection as for FIGS. 3 and 6.

FIG. 8 shows in the same projection as FIG. 6 a further design of the device according to the invention. This design likewise differs essentially from the embodiments described above in the relative arrangement of the parts of the device. In particular, in this design, the plug sector, i.e. the sector of the needle roller or section of the plug path, is very short, such that the path of the plug P assumes the form of a vertical tangent to the needle roller 2. The individual elements are essentially the same as those in FIG. 6 and therefore do not need to be described further at this point. For the yarn which is to be drawn in, the figure shows a yarn path F.2 which corresponds to the tangent line from the first yarn guide 12 to the rows of needles of the needle roller 2, a yarn path F.4 which can correspond to a yarn path in drawing-in with a clockwise cooling drum rotation (solid arrow 40) and a yarn path F.5 which corresponds to a path for counter-clockwise cooling drum rotation (segmented arrow 41). The figure shows that, depending on the exact position and diameter of the cooling drum 4, the guiding slot in the drawing-in yarn guide 5.2 must extend beyond the position 51 (intersection of the yarn guide with the tangent line from the first yarn guide to the rows of needles) if this is required by the yarn path F.5.

In all the devices described and illustrated in the figures hitherto, the cooling mechanism used is a rotating cooling drum. However, since the nature of the cooling mechanism does not have any effect on the solution to the problem on which the invention is based, other cooling mechanisms are also conceivable. In particular, cooling chambers, such as those described for example in the Swiss Application No. 3775/90-4 (application date 29 Nov., 1990, (FIGS. **4*a* and 4*b***), also assigned to the assignee of this invention and issued as counterpart U.S. Pat. No. 5,339,502 on Aug. 23, 1994, can be used.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A method for starting up continuous texturing of at least one untextured yarn, made from a thermoplastic material, including a texturing nozzle with at least one feed channel and at least one nozzle outlet, a first yarn guide located at an inlet of the texturing nozzle, a drawing-in yarn guide positioned at an outlet of the texturing nozzle; a plug guide roller with at least one pair of lateral plug guides, at least one plug separator and a plug cooling mechanism, wherein the starting up method for texturing the at least one untextured yarn comprises:

initially guiding each untextured yarn by the first yarn guide and subsequently guiding said each untextured yarn with the drawing-in yarn guide, located between the plug guide roller and the plug cooling mechanism, such that each yarn is located centrally between the lateral plug guides on the plug guide roller.

2. The method of claim 1, further including: guiding the untextured yarn via the first yarn guide and the drawing-in yarn guide for all possible yarn paths between a path on a tangent line from the first yarn guide to a cylindrical surface formed by the lateral plug guides and a path in which the yarn passes over a sector of the plug guide roller to a further yarn guide located downstream of the drawing-in yarn guide.

3. The method of claim 1 further including: guiding the untextured yarn during the drawing-in by the first yarn guide, the drawing-in yarn guide and, additionally, by means of guiding grooves on the plug guide roller.

4. The method of claim 2 further including: guiding the untextured yarn during the drawing-in by the first yarn guide, the drawing-in yarn guide and, additionally, by means of guiding grooves on the plug guide roller.

5. The method of claim 1 further including: keeping the drawing-in yarn guide stationary; and guiding the untextured yarn with a guiding slot of the drawing-in yarn guide.

6. The method of claim 2 further including: keeping the drawing-in yarn guide stationary; and guiding the untextured yarn with a guiding slot of the drawing-in yarn guide.

7. The method of claim 3 further including: keeping the drawing-in yarn guide stationary; and guiding the untextured yarn with a guiding slot of the drawing-in yarn guide.

8. A method for starting up continuous texturing of at least one yarn, made from a thermoplastic material, including a texturing nozzle with at least one feed channel and at least one nozzle outlet, a first yarn guide located at an inlet of the texturing nozzle, a drawing-in yarn guide positioned at an outlet of the texturing nozzle; a plug guide roller with at least one pair of lateral plug guides, at least one plug separator and a plug cooling mechanism, wherein the starting up method comprises:

initially guiding each untextured yarn by the first yarn guide and subsequently guiding said each untextured yarn with the drawing-in yarn guide located between the plug guide roller and the plug cooling mechanism; such that each yarn is located centrally between the lateral plug guides on the plug guide roller;

moving the drawing-in guide during the drawing-in process; guiding the untextured yarn by a guide rod; and equipping one of a feed part of the drawing-in guide and the guide rod with grooves.

9. The method of claim 2 further including: moving the drawing-in guide during the drawing-in process; guiding the untextured yarn by a guide rod; and equipping one of a feed part of the drawing-in guide and the guide rod with grooves.

10. The method of claim 3 further including: moving the drawing-in guide during the drawing-in process; guiding the untextured yarn by a guide rod; and equipping one of a feed part of the drawing-in guide and the guide rod with grooves.

11. A device for starting up continuous texturing of at least one untextured yarn, made from a thermoplastic material, the device including:

a texturing nozzle with at least one feed channel and at least one nozzle outlet;

a first yarn guide located in the area of an inlet to the texturizing nozzle;

a drawing-in yarn guide positioned in a vicinity of the at least one nozzle outlet;

a plug guide roller with at least one pair of lateral guides;

at least one plug separator; and a plug cooling mechanism, wherein the drawing-in yarn guide, located between the plug guide roller and the plug cooling mechanism, guides the at least one untextured yarn at the start of a texturing process for said at least one untextured yarn, such that the yarn is located centrally between the lateral guides on the plug guide roller.

12. The device of claim 11 wherein the device is used for the continuous texturing of multiple parallel yarns.

13. The device of claim 11 wherein the drawing-in yarn guide is stationary and is disposed so as to extend around a part of the circumference of the plug guide roller while being separated therefrom by a space, and having a guiding slot for the purpose of guiding the at least one yarn.

14. A device for starting up continuous texturing of at least one untextured yarn, made from a thermoplastic material, the device including:

a texturing nozzle with at least one feed channel and at least one nozzle outlet;

a first yarn guide located in the area of an inlet to the texturing nozzle;

a drawing-in yarn guide positioned in a vicinity of the at least one nozzle outlet;

a plug guide roller with at least one pair of lateral guides;

at least one plug separator; and a plug cooling mechanism, wherein the drawing-in yarn guide draws in the at least one untextured yarn at the start of a texturing process for said at least one untextured yarn;

wherein the drawing-in yarn guide is stationary and is disposed so as to extend around a part of the circumference of the plug guide roller while being separated therefrom by a space, and having a guiding slot for the purpose of guiding the at least one yarn; and wherein the drawing-in yarn guide includes a feed section, the feed section being located on the side, facing away from the plug guide roller, of a tangential plane from the first yarn guide to the cylindrical surface formed by the outer circumference of the lateral guides, a guide section adjoining the feed section and extending towards the plug separator with at least one guiding slot and a plug passage section located in the area of the plug separator with at least one plug passage aperture, each guiding slot opening into a plug passage aperture.

15. The device of claim 14 wherein each guiding slot continues on the opposite side of the plug passage aperture.

16. The device of claim 14 wherein the drawing-in yarn guide is designed and disposed so that its distance from the circumference of the plug guide roller varies.

17. A device for starting up continuous texturing of at least one untextured yarn, made from a thermoplastic material, the device including:

a texturing nozzle with at least one feed channel and at least one nozzle outlet;

a first yarn guide located in the area of an inlet to the texturing nozzle;

a drawing-in yarn guide positioned in a vicinity of the at least one nozzle outlet;

a plug guide roller with at least one pair of lateral guides;

at least one plug separator; and a plug cooling mechanism, wherein the drawing-in yarn guide draws in the at least one untextured yarn at the start of a texturing process for said at least one untextured yarn; and wherein the drawing-in yarn guide includes a guide rod which is positioned parallel to the axis of the plug guide roller and separated from its circumference by a space and linked to a means from driving so tha, during the drawing-in process, the yarn guide can be moved around a part of the circumference of the plug guide roller.

18. The device of claim 17 wherein the guide rod includes a feed part.

19. The device of claim 17 wherein the guide rod includes at least one guiding groove.

20. The device of claim 11 wherein the plug guide roller includes a guiding groove located between and parallel to each of the lateral guides.

21. The device of claim 13 wherein the plug guide roller includes a guiding groove located between and parallel to each of the lateral guides.

22. The device of claim 14 wherein the plug guide roller includes a guiding groove located between and parallel to each of the lateral guides.

23. The device of claim 17 wherein the plug guide roller includes a guiding groove located between and parallel to each of the lateral guides.

* * * * *